US009493318B2

(12) United States Patent
Kawamata et al.

(10) Patent No.: US 9,493,318 B2
(45) Date of Patent: Nov. 15, 2016

(54) CONVEYING DEVICE

(71) Applicant: BROTHER KOGYO KABUSHIKI KAISHA, Nagoya-shi, Aichi-ken (JP)

(72) Inventors: Noriyuki Kawamata, Nagoya (JP); Yasuhira Ota, Yatomi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/668,673

(22) Filed: Mar. 25, 2015

(65) Prior Publication Data

US 2015/0274462 A1 Oct. 1, 2015

(30) Foreign Application Priority Data

Mar. 31, 2014 (JP) ..... 2014-073836

(51) Int. Cl.

| | |
|---|---|
| ***B65H 5/02*** | (2006.01) |
| ***B65H 5/06*** | (2006.01) |
| ***B65H 5/26*** | (2006.01) |
| ***B65H 7/20*** | (2006.01) |

(52) U.S. Cl.

CPC ..... *B65H 5/068* (2013.01); *B65H 5/062* (2013.01); *B65H 5/26* (2013.01); *B65H 7/20* (2013.01); *B65H 2402/441* (2013.01); *B65H 2402/46* (2013.01); *B65H 2402/543* (2013.01); *B65H 2403/53* (2013.01); *B65H 2404/1442* (2013.01); *B65H 2404/6111* (2013.01); *B65H 2405/3322* (2013.01); *B65H 2407/20* (2013.01); *B65H 2511/212* (2013.01); *B65H 2515/34* (2013.01)

(58) Field of Classification Search

CPC ..... B65H 5/06; B65H 5/062; B65H 5/02; B65H 2404/14; B65H 2404/144; B65H 2404/1451; B65H 29/06; B65H 29/12; B65H 29/125; B65H 29/14; B65H 29/145; B65H 29/20; B65H 29/22; B65H 29/243; B65H 3/06; B65H 5/00

USPC ..... 271/272–274, 314, 264, 10.09; 347/104

See application file for complete search history.

(56) References Cited

U.S. PATENT DOCUMENTS

| | | | | |
|---|---|---|---|---|
| 5,833,381 | A * | 11/1998 | Kellogg et al. | 400/624 |
| 7,637,501 | B2 * | 12/2009 | Akiyama et al. | 271/273 |
| 2014/0203503 | A1 * | 7/2014 | Ishikura et al. | 271/273 |

FOREIGN PATENT DOCUMENTS

| | | | |
|---|---|---|---|
| JP | 4-7227 | * | 1/1992 |
| JP | H11-314793 | A | 11/1999 |
| JP | 2008-287242 | A | 11/2008 |

* cited by examiner

*Primary Examiner* — Thomas Morrison

(74) *Attorney, Agent, or Firm* — Merchant & Gould P.C.

(57) ABSTRACT

A conveying device includes: a housing having a conveyance path; a first roller disposed on the conveyance path; a second roller which is opposed to the first roller; a guide member whose state is changeable between a first state in which the guide member partly defines the conveyance path and a second state in which the guide member exposes the conveyance path; a roller holder supporting the second roller; an urging force applier configured to apply, to the second roller, an urging force in a first direction directed from the second roller toward the first roller; and an urging force adjuster configured to adjust the urging force to a first value when the guide member is in the first state and adjust the urging force to a second value when the guide member is in the second state, the second value being less than the first value.

16 Claims, 8 Drawing Sheets

CONVEYING DEVICE

CROSS REFERENCE TO RELATED APPLICATION

The present application claims priority from Japanese Patent Application No. 2014-073836, which was filed on Mar. 31, 2014, the disclosure of which is herein incorporated by reference in its entirety.

BACKGROUND

1. Technical Field

The present invention relates to a conveying device configured to convey a sheet along a conveyance path.

2. Description of the Related Art

There is known a conveying device including a housing in which a conveyance path is defined, and a sheet is conveyed by a conveying roller pair along the conveyance path. To perform maintenance and clear paper jam in the conveyance path, for example, the housing of the conveying device has an opening through which the conveyance path is accessible by a user. The opening can be opened and closed by a cover. Also, there is known a mechanism in which a nip of the conveying roller pair is released in conjunction with the opening of the cover.

SUMMARY

A nip force of the conveying roller pair is set with consideration of a relationship between the nip force of the conveying roller pair and forces by which other rollers convey a sheet (e.g., a frictional force and a nip force applied to the sheet). For example, by increasing a force of the conveying roller pair for conveying the sheet, i.e., a nip force of the conveying roller pair, with respect to a force of a sheet-supply roller for conveying a sheet, a conveying speed and a conveying distance of a sheet contacting the sheet-supply roller and nipped by the conveying roller pair are controlled depending principally upon a rotational speed and a rotation amount of the conveying roller pair. As thus described, the nip force of the conveying roller pair affects the conveying speed and the conveying distance of the sheet. Accordingly, the nip force of the conveying roller pair is preferably stable as designed.

In the above-described mechanism in which the nip of the roller pair is released in relation to a plurality of components, however, tolerance or play of the plurality of components may change the nip force of the conveying roller pair when the cover is opened or closed, for example.

Accordingly, an aspect of the disclosure relates to a conveying device capable of reducing a nip force of a first roller and a second roller with opening of a guide member and capable of stably restoring the nip force of the first roller and the second roller when the guide member is closed.

In one aspect of the disclosure, a conveying device includes: a housing formed with a conveyance path; a first roller disposed on the conveyance path; a second roller which is opposed to the first roller; a guide member whose state is changeable between a first state in which the guide member defines a part of the conveyance path and a second state in which the guide member exposes the conveyance path; a roller holder supporting the second roller; an urging force applier configured to apply, to the second roller, an urging force in a first direction directed from the second roller toward the first roller; and an urging force adjuster configured to adjust the urging force to a first value when the guide member is in the first state and adjust the urging force to a second value when the guide member is in the second state, the second value being less than the first value.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings. It is to be understood that the following embodiment is described only by way of example, and the disclosure may be otherwise embodied with various modifications without departing from the scope and spirit of the disclosure. A multi-function peripheral (MFP) 10 is used in a state illustrated in FIG. 1. In the present embodiment, three arrows illustrated in FIG. 1 indicate an up and down direction 7, a front and rear direction 8, and a right and left direction 9. In the following explanation, the up and down direction 7 is defined as an up and down direction of the MFP 10 illustrated in FIG. 1, i.e., the MFP 10 being in a normal state. Also, the front and rear direction 8 is defined by regarding a side of the MFP 10 on which an opening 13 is formed as a front side, and the right and left direction 9 is defined in a state in which the MFP 10 is viewed from the front side.

Overall Configuration of MFP 10

Figure 1:
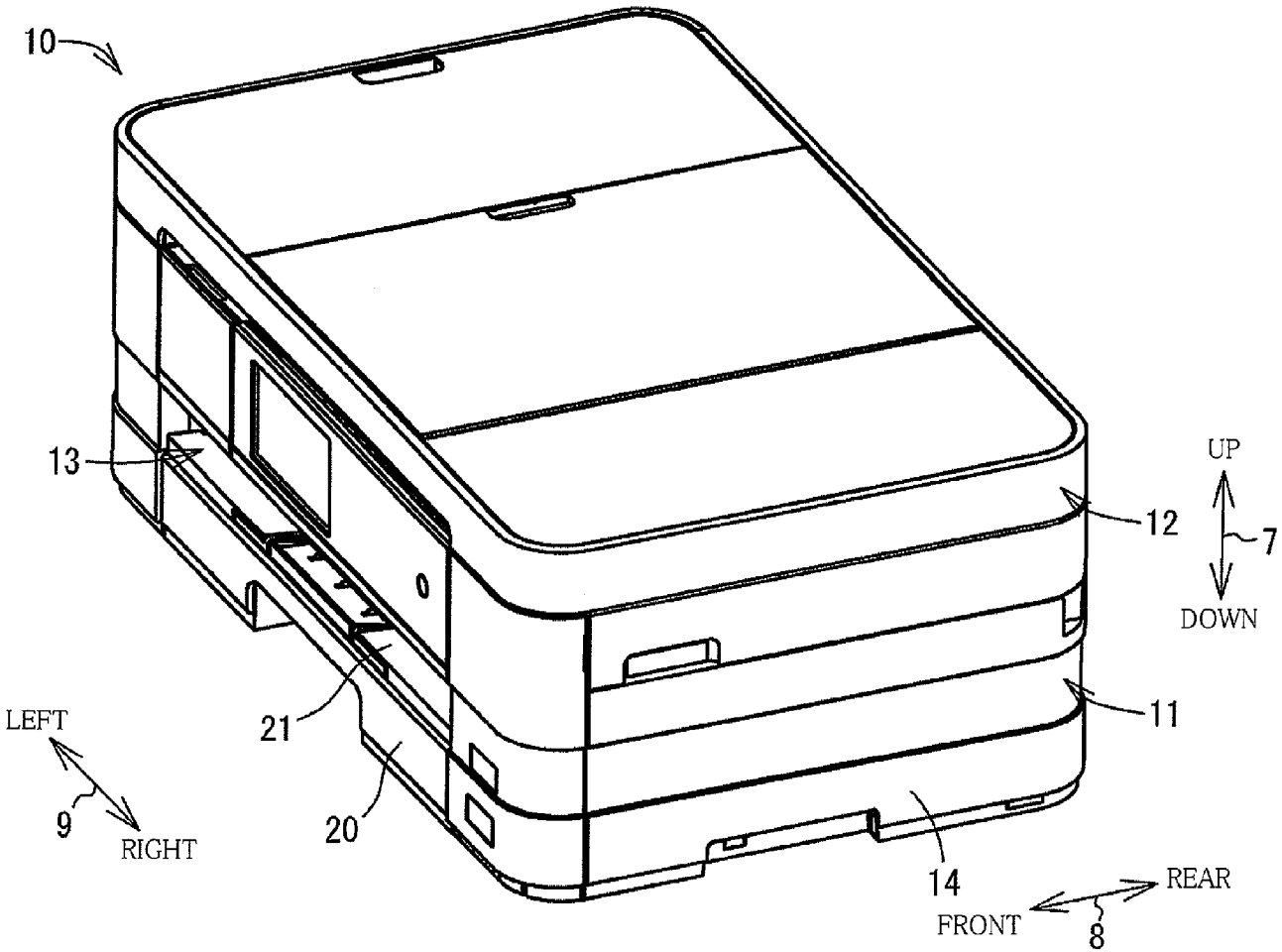
FIG. 1 is a perspective view illustrating a multi-function peripheral (MFP) according to one embodiment.

As illustrated in FIG. 1, the MFP 10 includes a housing 14 having a generally rectangular parallelepiped shape. The MFP 10 has various functions such as a facsimile function and a printing function.

A scanning unit 12 is provided in an upper portion of the housing 14. The scanning unit 12 is constituted as what is called a flatbed scanner, and a detailed explanation of an internal structure of the scanning unit 12 is omitted.

A printing unit 11 (as one example of a conveying device) is provided in a lower portion of the housing 14. The printing unit 11 has an ink-jet printing function for recording an image on a recording sheet. Devices and components provided in the housing 14 include a base frame 83, a pair of side frames 55, guide rails 56, 57, a supply tray 20, a conveyance path 65, a recording device 24, roller pairs 59, 44, guide members 18, 19, 31, and a roller holder 85.

Frame

Figure 7:
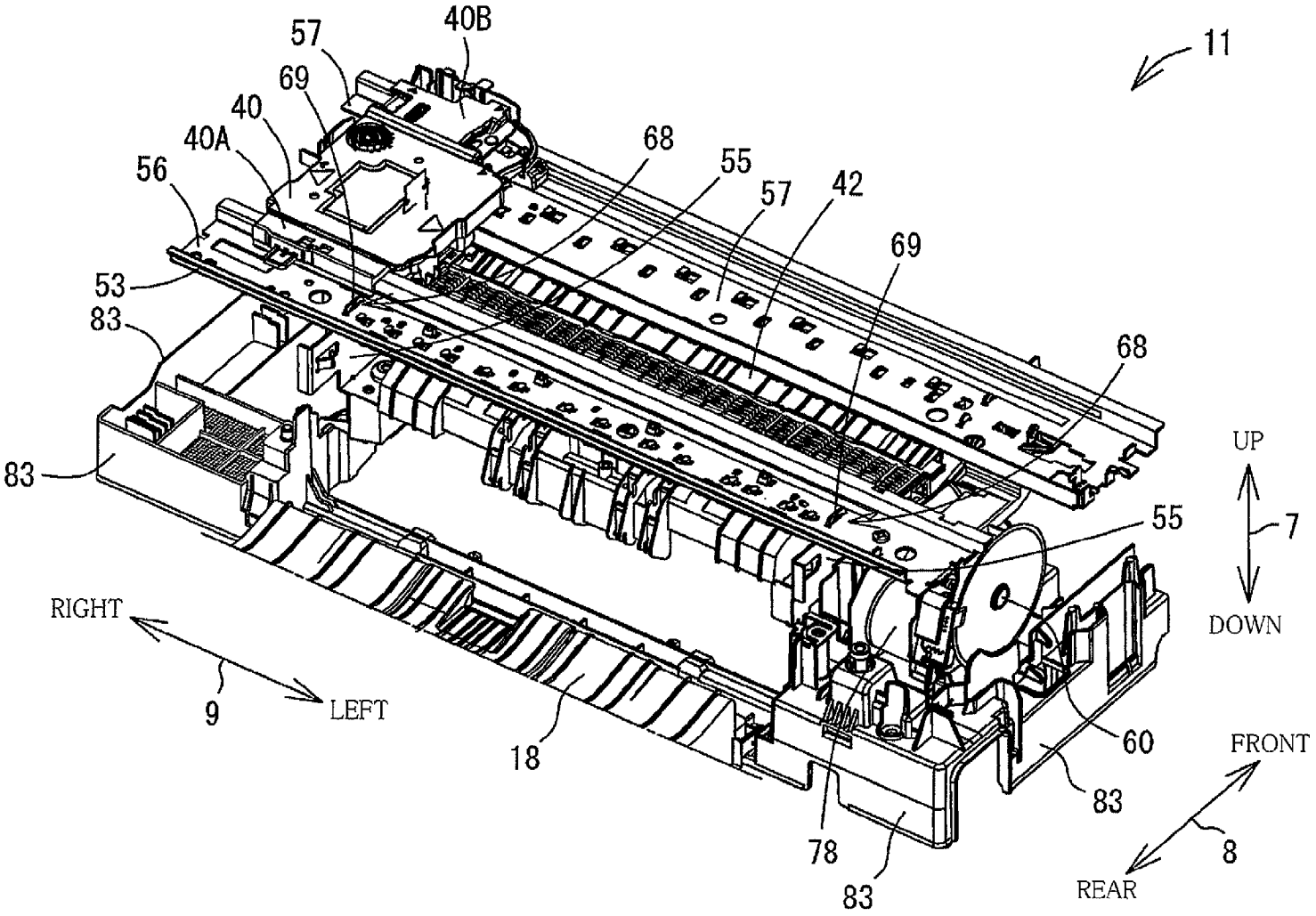
FIG. 7 is a perspective view illustrating a rear portion of the printing unit.

As illustrated in FIG. 7, the housing 14 contains at least three types of frames, namely, the base frame 83, the pair of side frames 55, and the guide rails 56, 57.

The base frame 83 is a resin frame forming a skeletal portion of a lower portion of the printing unit 11. The pair of side frames 55 are spaced apart from each other in the right and left direction 9. The side frames 55 are respectively disposed on right and left sides of the conveyance path 65. Each of the side frames 55 is a metal frame. The side frames 55 are supported by the base frame 83. The side frames 55 are secured to the base frame 83 by, e.g., screws.

The guide rails 56, 57 are spaced apart from each other in the front and rear direction 8. The guide rail 56 is one example of a frame. Each of the guide rails 56, 57 is a metal frame. Each of the guide rails 56, 57 is supported by the pair of side frames 55. Protruding portions 69 formed on the side frames 55 are respectively fitted in openings 68 formed in the guide rails 56, 57. As a result, each of the side frames 55 is coupled to the guide rails 56, 57. It is noted that the side frames 55 and the guide rails 56, 57 may be coupled to each other by methods other than the above-described one, for example, the side frames 55 and the guide rails 56, 57 may be coupled to each other by screws. The guide rails 56, 57 will be explained later in more detail.

Supply Tray 20

As illustrated in FIG. 1, the opening 13 is formed in a front portion of the printing unit 11. The supply tray 20 can be inserted and removed into and from the printing unit 11 in the front and rear direction 8 through the opening 13. The supply tray 20 is disposed in the lower portion (i.e., a bottom portion) of the housing 14 in the state in which the supply tray 20 is mounted in the printing unit 11. The supply tray 20 is shaped like a box opening upward. A multiplicity of recording sheets can be stacked on a bottom plate 22 of the supply tray 20 (see FIG. 2).

An uppermost one of the recording sheets placed on the bottom plate 22 is supplied to a curved portion 33 of the conveyance path 65 by a supply roller, not shown, which is provided above the bottom plate 22.

An output tray 21 is provided over the supply tray 20. The output tray 21 is moved in the front and rear direction 8 together with the supply tray 20. The recording sheet printed by the recording device 24 is discharged onto an upper surface of the output tray 21.

Conveyance Path 65

Figure 2:
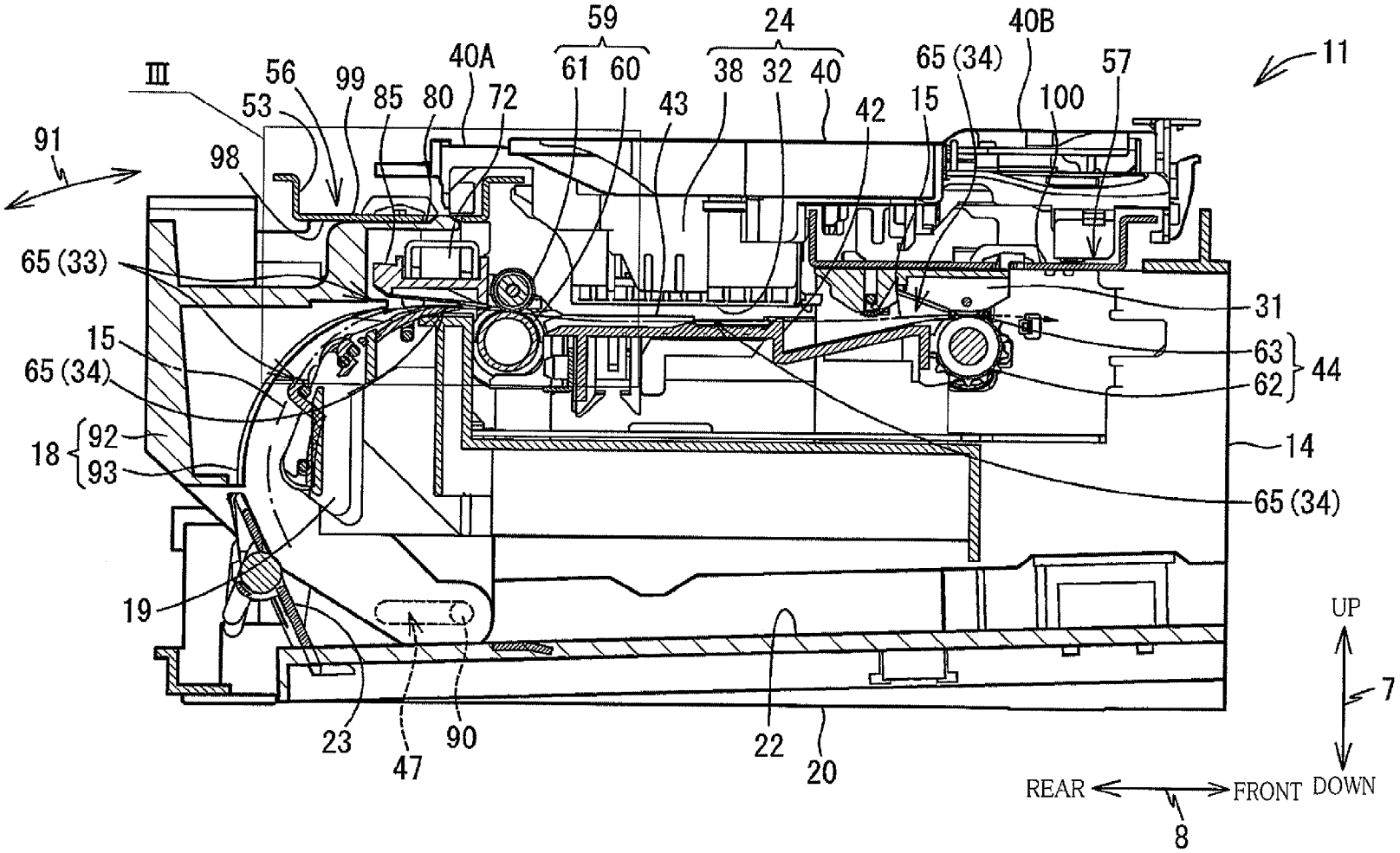
FIG. 2 is an elevational view in vertical cross section illustrating an internal structure of a printing unit, with an outer guide member located at a first position.

As illustrated in FIG. 2, the conveyance path 65 extends from a rear edge portion of the supply tray 20. The conveyance path 65 is constituted by the curved portion 33 and an extending portion 34. The curved portion 33 is curved upward from the rear edge portion of the supply tray 20. The extending portion 34 is continuous to an upper end of the curved portion 33 and extends in the front and rear direction 8.

The curved portion 33 is defined by the outer guide member 18 (as one example of a guide member), the roller holder 85, an inclined plate 23, and the inner guide member 19. The outer guide member 18, the roller holder 85, and the inclined plate 23 are opposed to and spaced apart from the inner guide member 19. The extending portion 34 is defined by the roller holder 85, the recording device 24, the upper guide member 31, the inner guide member 19, and a platen 42. In other words, the roller holder 85 defines at least a portion of the curved portion 33 and the extending portion 34. It is noted that the roller holder 85 may define at least a portion of only one of the curved portion 33 and the extending portion 34.

The recording sheet supported by the supply tray 20 is supplied by the supply roller to the inclined plate 23 provided on the supply tray 20. The inclined plate 23 changes a direction of travel of the recording sheet to supply the recording sheet into the curved portion 33. The recording sheet supplied into the curved portion is conveyed from a lower end to an upper end of the curved portion 33 and then to the conveying roller pair 59. The recording sheet nipped by the conveying roller pair 59 is conveyed in the front and rear direction 8 through the extending portion 34 toward the recording device 24. Under the recording device 24, the recording device 24 records an image on the conveyed recording sheet. The recording sheet on which the image has been recorded is conveyed further in the front and rear direction 8 through the extending portion 34 and discharged onto the output tray 21. In view of the above, the recording sheet is conveyed in a conveying direction 15 indicated by the one-dot chain line arrow in FIG. 2.

Recording Device 24

As illustrated in FIG. 2, the recording device 24 is provided on an upper side of the extending portion 34. The platen 42 is provided under the recording device 24 so as to be opposed to the recording device 24. The platen 42 is provided with a plurality of ribs 43 standing upright on an upper surface of the platen 42 and extending in the front and rear direction 8. The ribs 43 are spaced apart from each other in the right and left direction 9. The ribs 43 support the recording sheet conveyed through the extending portion 34 of the conveyance path 65.

The recording device 24 includes a carriage 40 and a recording head 38. The carriage 40 is supported by the guide rails 56, 57 so as to be reciprocable in the right and left direction 9. A rear end portion 40A of the carriage 40 is held in contact with an upper surface 99 (as one example of a first contact surface) of the guide rail 56. A front end portion 40B of the carriage 40 is held in contact with an upper surface 100 of the guide rail 57.

The recording head 38 is mounted on the carriage 40. Ink is supplied from an ink cartridge, not shown, to the recording head 38. A lower surface 32 of the recording head 38 has a multiplicity of nozzles, not shown. During movement of the carriage 40 in the right and left direction 9, the recording head 38 ejects ink droplets from the nozzles toward the platen 42. As a result, an image is formed on the recording sheet conveyed along the extending portion 34 and supported on the platen 42.

Conveying Roller Pair 59 and Output Roller Pair 44

Figure 3:
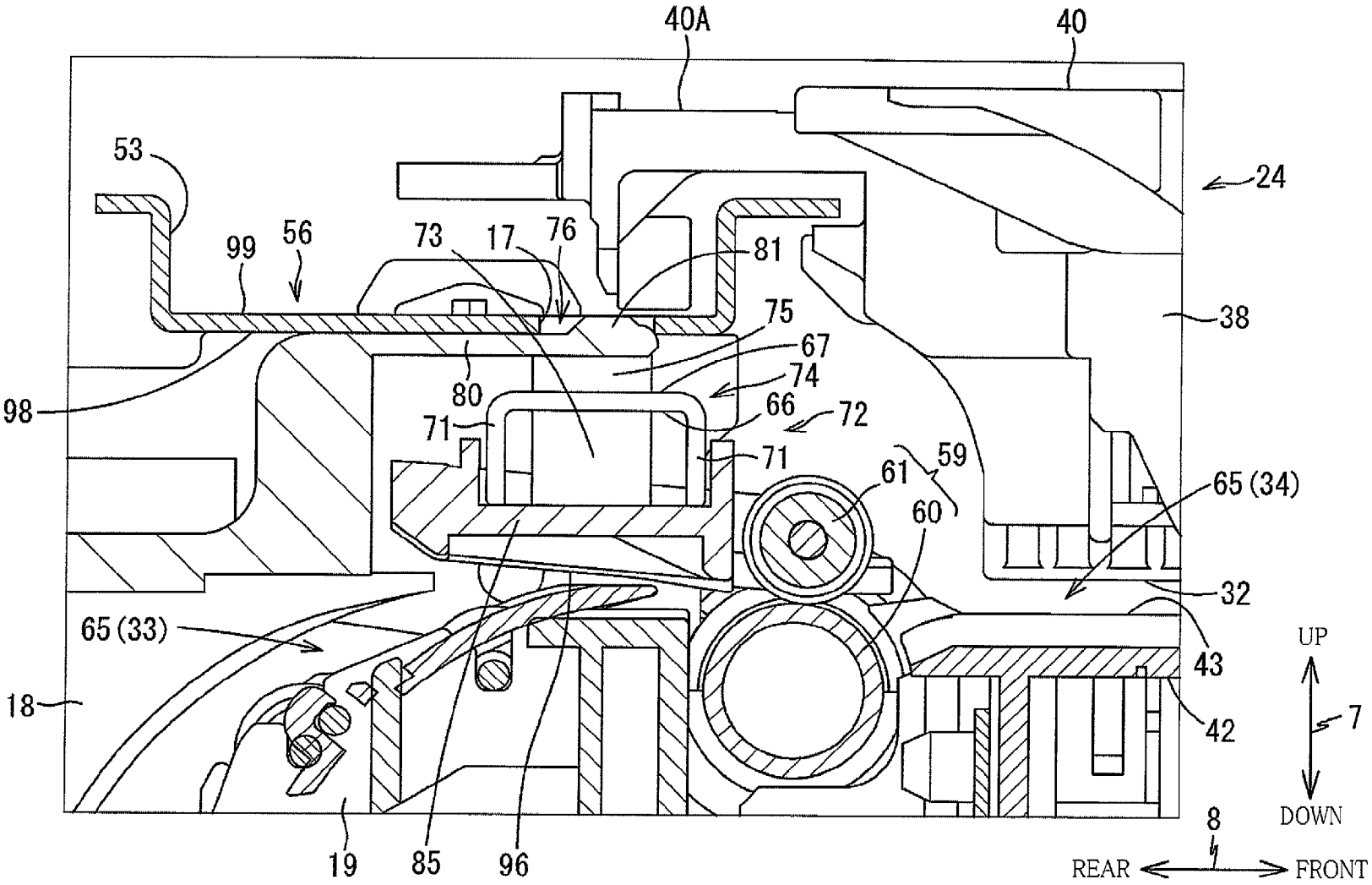
FIG. 3 is an enlarged view of an area III in FIG. 2.

As illustrated in FIGS. 2 and 3, the conveying roller pair 59 is disposed on the extending portion 34 at a position located upstream of the recording device 24 in the conveying direction 15. The output roller pair 44 is disposed on the extending portion 34 at a position located downstream of the recording device 24 in the conveying direction 15.

The conveying roller pair 59 includes: a conveying roller 60 (as one example of a first roller) disposed on a lower side of the extending portion 34; and pinch rollers 61 (each as one example of a second roller) disposed on an upper side of the extending portion 34 and opposed to the conveying roller 60. The conveying roller 60 is rotated, with the right and left direction 9 being as its axial direction. The pinch rollers 61 are spaced apart from each other in the right and left direction 9. Each of the pinch rollers 61 is rotated, with the right and left direction 9 being as its axial direction. Each of the pinch rollers 61 is pressed onto the conveying roller 60 respectively by coil springs 73.

The conveying roller 60 is rotatably supported by the pair of side frames 55 (see FIG. 7). The pinch rollers 61 are rotatably supported by the roller holder 85.

The output roller pair 44 includes: an output roller 62 disposed on a lower side of the extending portion 34; and spur rollers 63 disposed on an upper side of the extending portion 34 and opposed to the output roller 62. Each of the output roller 62 and the spur rollers 63 is rotated, with the right and left direction 9 being as their axial direction. The spur rollers 63 are pressed onto the output roller 62 respectively by resilient members, not shown. The output roller 62 is rotatably supported by the pair of side frames 55 (see FIG. 7). The spur rollers 63 are rotatably supported by the upper guide member 31.

The conveying roller 60 and the output roller 62 are rotated by a driving force generated by a motor 78 (see FIG. 7). When the conveying roller 60 is rotated in a state in which the recording sheet is nipped by the conveying roller pair 59, the recording sheet is conveyed by the conveying roller pair 59 in the conveying direction 15 toward the platen 42. When the output roller 62 is rotated in a state in which the recording sheet is nipped by the output roller pair 44, the recording sheet is conveyed by the output roller pair 44 in the conveying direction 15 toward the output tray 21. It is noted that a force may be transmitted to the conveying roller 60 and the output roller 62 from a motor different from the motor 78.

Guide Rails 56, 57

Each of the guide rails 56, 57 illustrated in FIG. 2 is generally shaped like a plate extending in the front and rear direction 8 and in the right and left direction 9. As illustrated in FIGS. 2, 3, and 7, a rear end portion of the guide rail 56 is bent upward so as to form a rear bent portion 53. As illustrated in FIG. 2, the guide rail 57 is located in front of the guide rail 56. Front and rear end portions of the carriage 40 are respectively supported by the guide rails 56, 57.

A well-known belt mechanism, not shown, is disposed on an upper surface of the guide rail 57. The belt mechanism includes: pulleys respectively disposed on right and left end portions of the guide rail 57; and a belt looped over the pulleys. The belt is coupled to the carriage 40 and a carriage driving motor, not shown, for applying a driving force to the carriage 40. Upon driving of the carriage driving motor, the driving force is transmitted to the carriage 40 via the belt mechanism such that the carriage 40 is moved in the right and left direction 9. As a result, the carriage 40 is reciprocated in the right and left direction 9.

Outer Guide Member 18

As illustrated in FIG. 2, the outer guide member 18 is provided upstream of the conveying roller pair 59 in the conveying direction 15. The outer guide member 18 can be pivoted or swung in the direction indicated by an arrow 91 about a shaft 90 extending in the right and left direction 9. In the lower or bottom portion of the housing 14, the shaft 90 protrudes outward from opposite ends of the outer guide member 18 in the right and left direction 9. The shaft 90 is supported by bearings, not shown, of the housing 14, so that the outer guide member 18 is pivotably supported by the housing 14. It is noted that FIG. 7 omits illustration of a distal end portion of the outer guide member 18.

The above-described bearings respectively have elongated holes 47 each extending in the front and rear direction 8. The shaft 90 is fitted in the elongated holes 47. This construction allows the outer guide member 18 to be pivoted in the direction indicated by the arrow 91 and to be moved in the front and rear direction 8.

The outer guide member 18 includes: a side wall 92 partly constituting a rear surface of the housing 14; and a guide portion 93 disposed in front of the side wall 92 and supported by the side wall 92. The guide portion 93 is shaped like a plate curved at a portion thereof near the curved portion 33.

Figure 6:
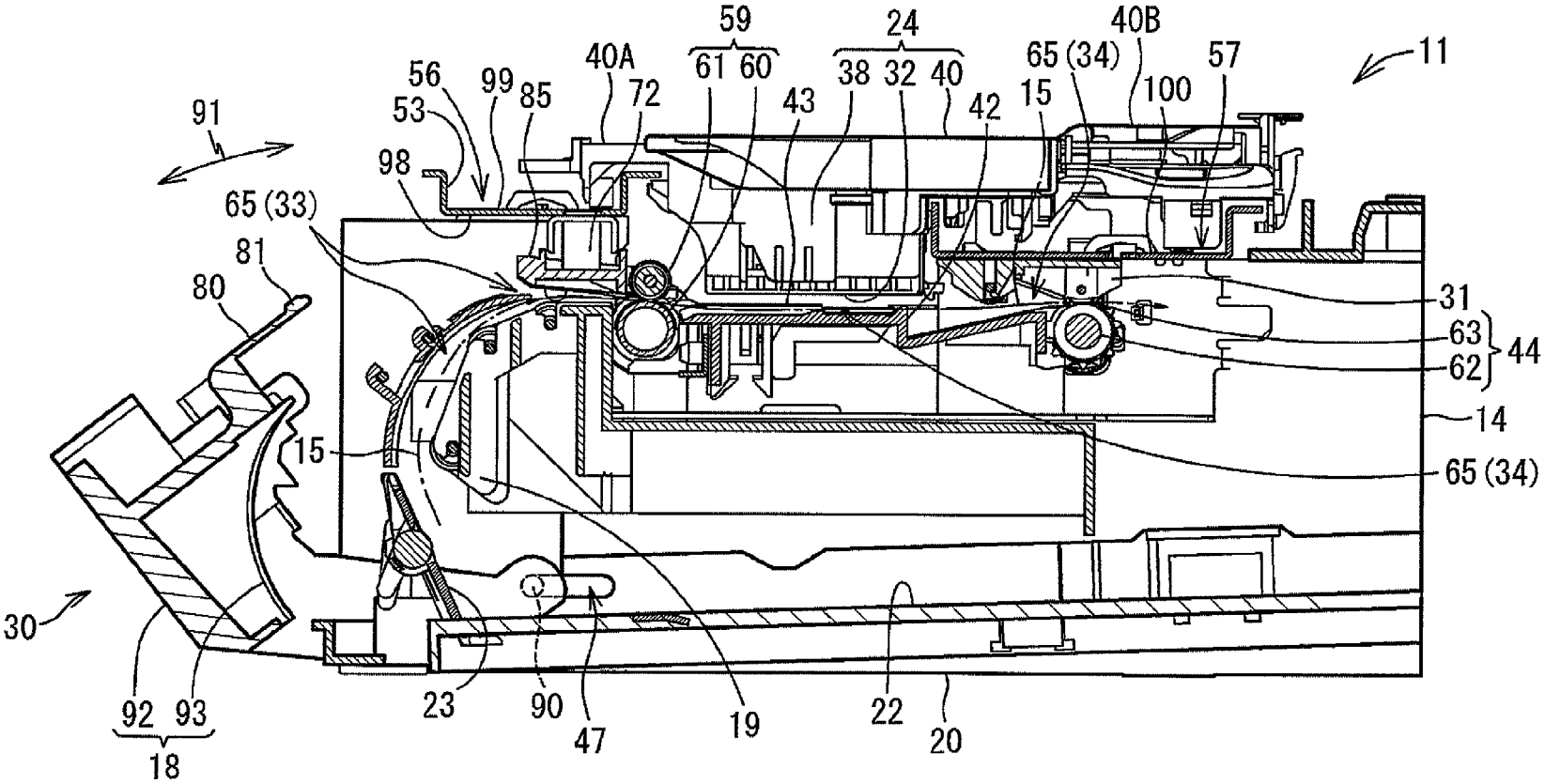
FIG. 6 is an elevational view in vertical cross section illustrating the internal structure of the printing unit, with the outer guide member located at a second position.

The outer guide member 18 is pivoted between a first position illustrated in FIG. 2 and a second position illustrated in FIG. 6. When the outer guide member 18 is located at the first position, the guide portion 93 covers an outer part of the curved portion 33. This state of the outer guide member 18 located at the first position is one example of a first state. When the outer guide member 18 is located at the second position, the curved portion 33 is exposed to an outside. This state of the outer guide member 18 located at the second position is one example of a second state. A user of the MFP 10 can pivot the outer guide member 18 from the first position to the second position to remove a recording sheet jammed in the curved portion 33.

Roller Holder 85

As illustrated in FIGS. 2 and 3, the roller holder 85 is disposed under the guide rail 56 at a position between the outer guide member 18 and the conveying roller pair 59 in the conveying direction 15. The roller holder 85 is elongated in the right and left direction 9. A front portion of the roller holder 85 supports the pinch rollers 61 such that the pinch rollers 61 are rotatable.

Figure 8:
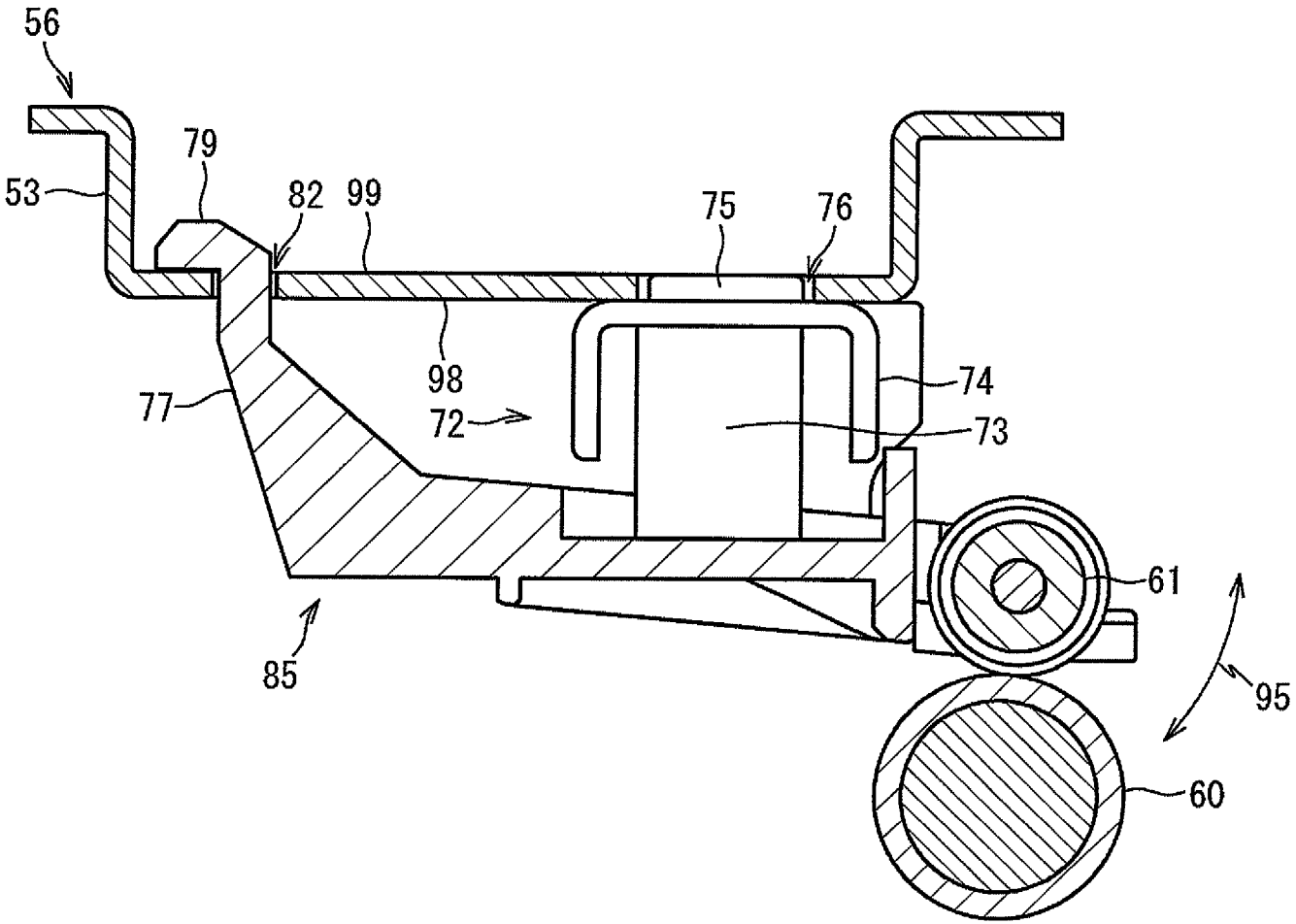
FIG. 8 is an elevational view in vertical cross section schematically illustrating a roller holder and a guide rail.

The roller holder 85 is supported by the guide rail 56 so as to be pivotable, with its front portion being as a distal end portion. This construction will be explained in detail. As illustrated in FIG. 8, a rear portion of the roller holder 85 includes projecting portions 77 projecting upward. The projecting portions 77 are formed on right and left sides of pairs of the coil springs 73 and engagement members 74 which are arranged in the right and left direction 9. A distal end portion of each of the projecting portions 77 has a bent portion 79 which is bent rearward. A rear portion of the guide rail 56 has openings 82 located opposite the respective projecting portions 77. Each of the openings 82 is slightly larger in outer shape than a corresponding one of the projecting portions 77. The projecting portions 77 are fitted in the respective openings 82. The bent portions 79 and the upper surface 99 of the guide rail 56 are engaged with each other in the state in which the projecting portions 77 are fitted in the respective openings 82. With the above-described construction of the roller holder 85 and the guide rail 56, the roller holder 85 is pivoted in a direction indicated by an arrow 95 by an amount corresponding to play or backlash of the projecting portions 77 fitted in the respective openings 82 with respect to the respective openings 82.

It is noted that the construction in which the roller holder 85 is pivotably supported by the guide rail 56 is not limited to the above-described construction, and a well-known mechanism may be employed. For example, the MFP 10 may be configured such that a shaft extending in the right and left direction 9 is provided in a rear end portion of the roller holder 85, and the shaft is supported by the guide rail 56. Also, the roller holder 85 may be pivotably supported by a component (e.g., the side frames 55) different from the guide rail 56.

As illustrated in FIGS. 2 and 3, when the outer guide member 18 is located at the first position, a rear portion of a lower surface 96 of the roller holder 85 covers the outer part of the curved portion 33, and a front portion of the lower surface 96 of the roller holder 85 covers an upper part of the extending portion 34.

The pinch rollers 61 supported by the roller holder 85 contact the conveying roller 60 from an upper side thereof. In the state in which the pinch rollers 61 and the conveying roller 60 are held in contact with each other, the shaft of the pinch rollers 61 is located in front of the shaft of the conveying roller 60. Consequently, the recording sheet nipped by the conveying roller pair 59 is conveyed obliquely downward in the front direction and pressed onto the platen 42. This construction can fix a distance between the recording head 38 and the recording sheet supported by the platen 42.

Coil Springs 73 and Engagement Members 74

As illustrated in FIGS. 2 and 3, the roller holder 85 is provided with an urging member 72 (as one example of an urging force applier) for urging the pinch rollers 61 toward the conveying roller 60. The urging member 72 includes the coil springs 73 (each as one example of a resilient member and a compression coil spring) and the engagement members 74 (each as one example of a cover). Each of the coil springs 73 and a corresponding one of the engagement members 74 are provided as a pair. The pairs of the coil springs 73 and the engagement members 74 are spaced apart from each other in the right and left direction 9. Each of the coil springs 73 is supported by the roller holder 85, and each of the engagement members 74 is supported by the corresponding one of the coil springs 73. The coil springs 73 are interposed between the roller holder 85 and the respective engagement members 74.

Lower end portions of the respective coil springs 73 are held in contact with the roller holder 85, and upper end portions of the respective coil springs 73 are held in contact with the respective engagement members 74. Lower surfaces 66 of the respective engagement members 74 are respectively held in contact with the upper end portions of the respective coil springs 73. Each of the engagement members 74 has side portions 71 extending downward from the corresponding lower surface 66. The lower surface 66 and the side portions 71 of the engagement member 74 cover the coil spring 73.

Projections 75 are formed on upper surfaces of the respective engagement members 74. The guide rail 56 has openings 76 (each as one example of an engaging portion) at positions corresponding to the respective engagement members 74.

Figure 4:
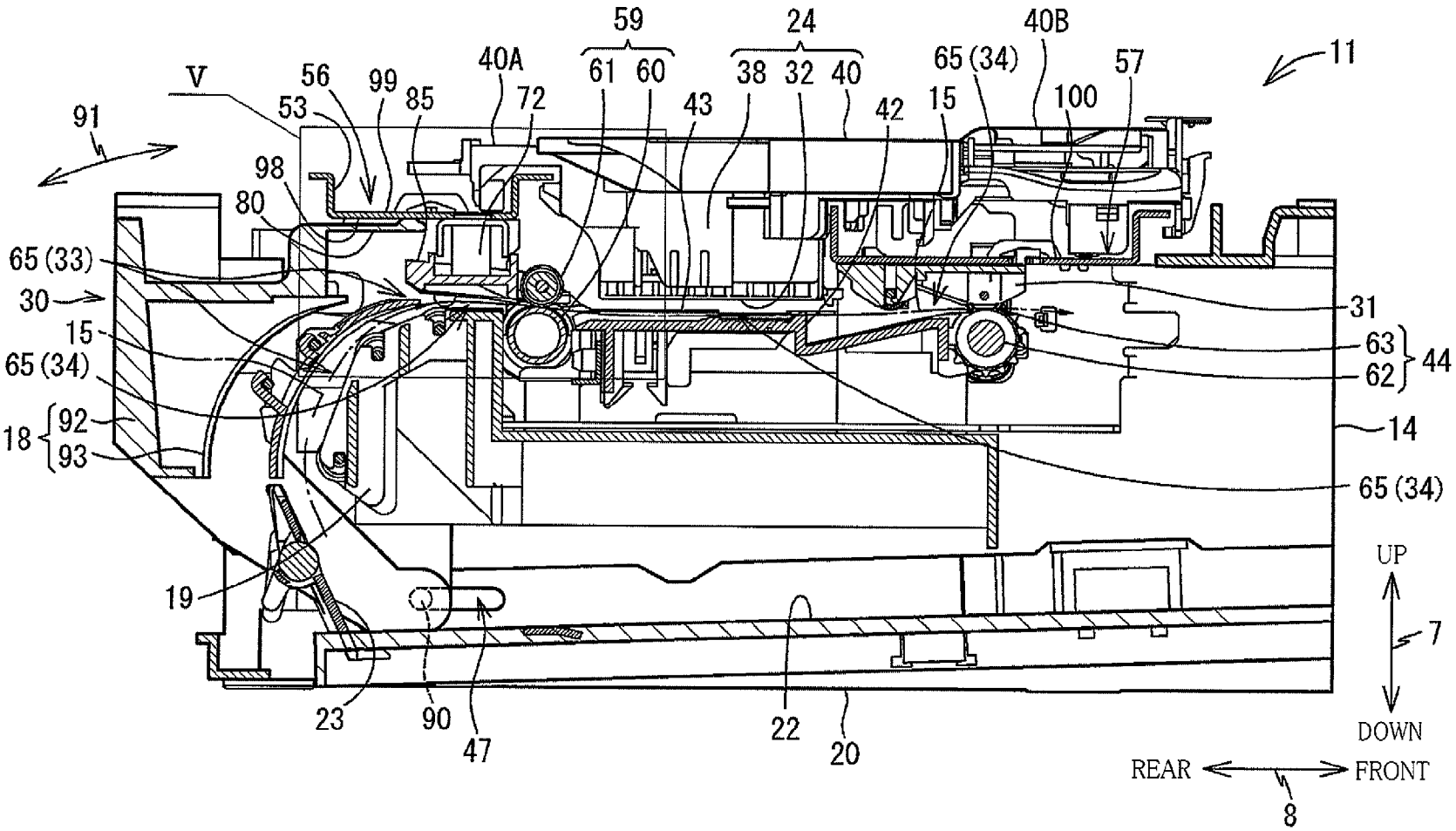
FIG. 4 is an elevational view in vertical cross section illustrating the internal structure of the printing unit when the outer guide member is located nearer to a second position than the position of the outer guide member illustrated in FIG. 2.
Figure 5:
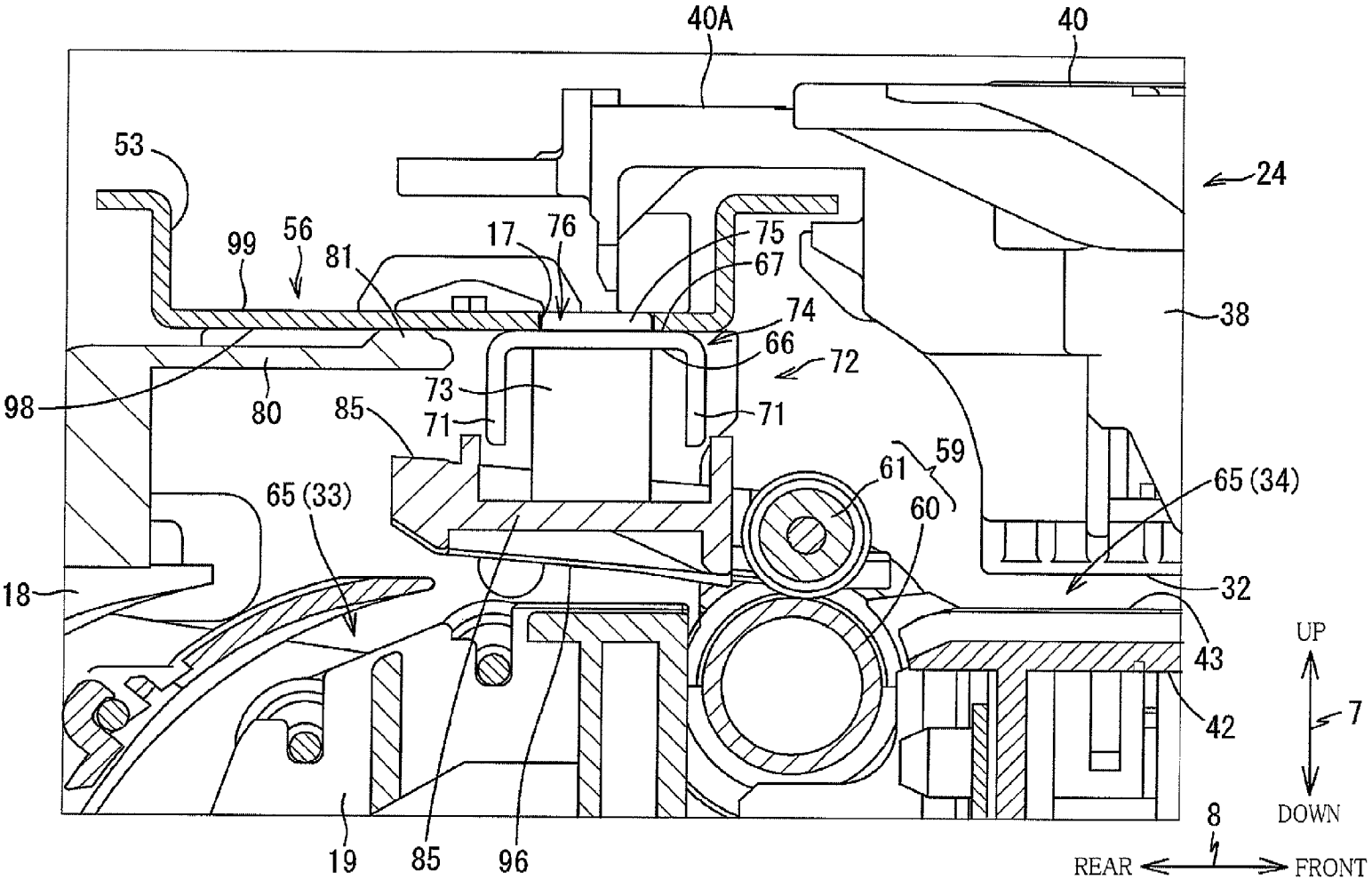
FIG. 5 is an enlarged view of an area V in FIG. 4.

As illustrated in FIGS. 2 and 3, when the outer guide member 18 is located at the first position, the projections 75 provided on the respective engagement members 74 are respectively held in contact with load adjusting members 80 (each as one example of an urging force adjuster). As illustrated in FIGS. 4-6, when the outer guide member 18 is located nearer to the second position than to the first position, upper surfaces 67 of the respective engagement members 74 are held in contact with a lower surface 98 of the guide rail 56.

The engagement members 74 are movable with respect to the roller holder 85 via the respective coil springs 73. Specifically, each of the engagement members 74 can be moved, by extension and compression of the corresponding coil spring 73, between an upper position illustrated in FIGS. 4 and 5 (as one example of a second position of the cover) and a lower position illustrated in FIGS. 2 and 3 (as one example of a first position of the cover) which is located on a lower side of the upper position.

In the present embodiment, the coil springs 73 are used for urging the respective projections 75 upward and urging the respective pinch rollers 61 toward the conveying roller 60. However, an urging member for urging the projections 75 upward and an urging member for urging the pinch rollers 61 toward the conveying roller 60 may be independent of each other.

Load Adjusting Member 80

As illustrated in FIGS. 2 and 3, the load adjusting members 80 are formed on the outer guide member 18 integrally with each other. The load adjusting members 80 protrude frontward from the distal end portion of the outer guide member 18 located at the first position. The load adjusting members 80 are spaced apart from each other in the right and left direction 9. Specifically, each of the load adjusting members 80 is provided so as to correspond to a corresponding one of the coil springs 73 and a corresponding one of the engagement members 74. It is noted that the following explanation is provided for one of the load adjusting members 80 for simplicity unless otherwise required by context.

When the outer guide member 18 is located at the first position, an upper surface of the load adjusting member 80 is held in contact with the lower surface 98 (as one example of a second contact surface) of the guide rail 56, and a lower surface of the load adjusting member 80 is held in contact with the projection 75 provided on the engagement member 74. As a result, the load adjusting member 80 is interposed between the guide rail 56 and the urging member 72. The coil spring 73 is compressed by the load adjusting member 80 in this state, resulting in increase in an urging force of the urging member 72. In this state, the engagement member 74 is located at the lower position, and the urging force generated by the coil spring 73 is a first urging force.

A distal end portion of the load adjusting member 80 is provided with a projecting portion 81. The projecting portion 81 projects upward from the upper surface of the load adjusting member 80 in the state in which the outer guide member 18 is located at the first position. When the outer guide member 18 is located at the first position, the projecting portion 81 is inserted into the corresponding opening 76 of the guide rail 56. As a result, the load adjusting member 80 is engaged with the opening 76 when the outer guide member 18 is located at the first position. It is noted that the load adjusting member 80 may not have the projecting portion 81.

When the outer guide member 18 is moved in the front and rear direction 8, the load adjusting member 80 is moved in the front and rear direction 8 integrally with the outer guide member 18. When the outer guide member 18 is pivoted in the direction indicated by the arrow 91, the load adjusting member 80 is pivoted in the direction indicated by the arrow 91 integrally with the outer guide member 18. In other words, the load adjusting member 80 moves in the direction indicated by the arrow 91 and in the front and rear direction 8 intersecting the downward direction in which the urging member 72 urges the pinch roller 61, in conjunction with a change in the state of the outer guide member 18.

As illustrated in FIG. 6, when the outer guide member 18 is located at the second position, the load adjusting member 80 is spaced apart from the urging member 72. In this state, the engagement member 74 is located at the upper position, and the urging force generated by the coil spring 73 is a second urging force which is less than the first urging force.

Pivotal Movement of Outer Guide Member 18

There will be next explained the pivotal movement of the outer guide member 18. First, movement of the outer guide member 18 from the first position to the second position will be explained.

As illustrated in FIGS. 2 and 3, when the outer guide member 18 is located at the first position, the load adjusting member 80 is interposed between the guide rail 56 and the urging member 72. In this state, the load adjusting member 80 is urged upward by the urging member 72. The projecting portion 81 is inserted in the opening 76 of the guide rail 56, and the load adjusting member 80 is engaged with the opening 76.

When the outer guide member 18 is located at the first position, the engagement member 74 is located at the lower position. When the outer guide member 18 is located at the first position, each of the pinch rollers 61 is pressed on the conveying roller 60 by the first urging force of the urging member 72.

When the outer guide member 18 is located at the first position, the shaft 90 is located at a front end portion of each of the elongated holes 47. In this state, the movement of the load adjusting member 80 in the up and down direction 7 is limited by the guide rail 56 and the urging member 72. For this reason, the outer guide member 18 cannot be pivoted in the direction indicated by the arrow 91. Thus, the outer guide member 18 is moved rearward from the first position to a position illustrated in FIG. 4 by movement of the shaft 90 from the front end portion to a rear end portion of each of the elongated holes 47.

When the outer guide member 18 is moved rearward, the projecting portion 81 is brought into contact with a rear side surface 17 of the opening 76 so as to press the rear side surface 17. As a result, the projecting portion 81 receives a force of reaction from the rear side surface 17. The force of the reaction bends the load adjusting member 80 downward. As a result, the projecting portion 81 comes out of the opening 76, which releases the engagement of the load adjusting member 80 and the opening 76.

When the outer guide member 18 is moved further rearward and reaches the position illustrated in FIG. 4, the load adjusting member 80 is moved off the urging member 72. As a result, the engagement member 74 is urged by the coil spring 73 and moved from the lower position to the upper position, so that the projection 75 is inserted into the opening 76, resulting in extension of the coil spring 73. Also in this state, the urging member 72 urges the pinch roller 61 toward the conveying roller 60 by the second urging force that is smaller than the first urging force. However, since the coil spring 73 is extended, a pressing force of the pinch roller 61 on the conveying roller 60 is smaller than that in the state in which the outer guide member 18 is located at the first position.

When the outer guide member 18 is located at the position illustrated in FIG. 4, the load adjusting member 80 is located at the position located at a rear of its position illustrated in FIG. 2, and the load adjusting member 80 is not interposed between the guide rail 56 and the urging member 72. Thus, even when the load adjusting member 80 is moved by the pivotal movement of the outer guide member 18 in the direction indicated by the arrow 91, the movement is not limited by the guide rail 56 and the urging member 72.

When the outer guide member 18 is pivoted from the position illustrated in FIG. 4 to the second position (see FIG. 6), the curved portion 33 is exposed.

There will be next explained operations when the outer guide member 18 is moved from the second position to the first position. First, the outer guide member 18 is pivoted, in the direction indicated by the arrow 91, from the second position toward the position illustrated in FIG. 4. As a result, the curved portion 33 is not exposed.

The outer guide member 18 is then moved frontward from the position illustrated in FIG. 4 to the first position. This movement causes the distal end portion of the load adjusting member 80 to contact and press the side portion 71 of the engagement member 74. Consequently, the load adjusting member 80 enters into a position between the guide rail 56 and the engagement member 74, and the engagement member 74 is moved from the upper position to the lower position against the urging force of the urging member 72. The movement of the engagement member 74 to the lower position causes the projection 75 to come out of the opening 76. As a result, the coil spring 73 is compressed, which increases the pressing force of the pinch roller 61 on the conveying roller 60.

When the outer guide member 18 is moved further in the front direction, the projecting portion 81 is inserted into the opening 76. As a result, the outer guide member 18 is positioned at the first position.

Effects of Embodiment

In the present embodiment, when the outer guide member 18 is located at the first position, the curved portion 33 of the conveyance path 65 is defined or covered by the outer guide member 18, and the load adjusting member 80 increases the urging force of the urging member 72 when compared with the situation in which the urging member 72 does not contact the load adjusting member 80. When the outer guide member 18 is located at the second position, the curved portion 33 is exposed, and the load adjusting member 80 is spaced apart from the urging member 72, resulting in reduction in the urging force of the urging member 72.

In the present embodiment, the load adjusting member 80 is interposed between the guide rail 56 and the urging member 72. Thus, the load adjusting member 80 can be constructed easily.

In the present embodiment, the load adjusting member 80 is moved in the rear direction intersecting the down direction in which the urging member 72 urges the pinch roller 61 in conjunction with the movement of the outer guide member 18. Accordingly, a component or components other than the load adjusting member 80 such as the guide rail 56 can be disposed in a space located over the load adjusting member 80.

In the present embodiment, the load adjusting member 80 is engaged with the opening 76 formed in the guide rail 56. This construction stabilizes the position at which the load adjusting member 80 contacts the urging member 72.

Modifications

In the above-described embodiment, the outer guide member 18 is moved in the front and rear direction 8 and pivoted in the direction indicated by the arrow 91 to move between the first position and the second position. However, the outer guide member 18 is not limited to this construction. For example, the outer guide member 18 may be mounted on and removed from the housing 14. In this case, a state in which the outer guide member 18 is mounted on the housing 14 is one example of the first state, and a state in which the outer guide member 18 is removed from the housing 14 is one example of the second state. In the above-described embodiment, when the outer guide member 18 is located at the second position, the load adjusting member 80 is spaced apart from the urging member 72, but the present invention is not limited to this construction. For example, the MFP 10 may be configured such that when the outer guide member 18 is located at the first position, the load adjusting member 80 is held in contact with the urging member 72, and the urging force generated by the urging member 72 is the first urging force and such that when the outer guide member 18 is located at the second position, the load adjusting member 80 is held in contact with the urging member 72, and the urging force generated by the urging member 72 is the second urging force that is smaller than the first urging force.

While the conveying roller pair 59 is constituted by the conveying roller 60 and the pinch rollers 61 which are located on an upper side of the conveying roller 60 in the above-described embodiment, the conveying roller 60 may be provided on an upper side of the pinch rollers 61. In this case, the engagement member 74 is configured to be engaged with a frame, not shown, provided in the housing 14 which is different from the guide rail 56.

While the printing unit 11 is one example of the conveying device in the above-described embodiment, the conveying device is not limited to the printing unit 11, and any device having the conveyance path may be employed as the conveying device. For example, a construction similar to that of the above-described conveying device may be applied to the scanning unit 12 having a conveyance path through which a document is conveyed. That is, the scanning unit 12 may be one example of the conveying device.

What is claimed is:

1. A conveying device, comprising:

a housing formed with a conveyance path;

a first roller disposed on the conveyance path;

a second roller which is opposed to the first roller;

a guide member whose state is changeable between a first state in which the guide member defines a part of the conveyance path and a second state in which the guide member exposes the conveyance path;

a frame disposed in the housing, the frame including a first contact surface and a second contact surface which is a back side from the first contact surface;

a recording device supported by the frame and contacting the first contact surface of the frame, the recording device configured to record an image on a sheet conveyed along the conveyance path, a roller holder supported in the housing by the frame, the roller holder supporting the second roller;

an urging force applier configured to apply, to the second roller, an urging force in a first direction directed from the second roller toward the first roller; and an urging force adjuster configured to adjust the urging force to a first value when the guide member is in the first state and adjust the urging force to a second value when the guide member is in the second state, the second value being less than the first value;

wherein the urging force adjuster contacts the second contact surface when the guide member is in the first state; and wherein the urging force adjuster is located between the frame and the urging force applier when the guide member is in the first state.

2. The conveying device according to claim 1, wherein the urging force adjuster contacts the urging force applier when the guide member is in the first state, and the urging force adjuster is spaced apart from the urging force applier when the guide member is in the second state.

3. The conveying device according to claim 1, wherein the urging force adjuster is configured to be moved in a direction intersecting the first direction, in conjunction with the change in the state of the guide member.

4. The conveying device according to claim 1, wherein the frame comprises an engaging portion, and wherein the urging force adjuster is engaged with the engaging portion when the guide member is in the first state.

5. The conveying device according to claim 1, wherein the guide member serves as at least a portion of a side wall of the housing.

6. The conveying device according to claim 1, wherein the urging force applier comprises a resilient member and a cover which contacts an end portion of the resilient member, wherein the cover is movable relative to the roller holder, and wherein the resilient member is located between the roller holder and the cover and configured to urge the cover in a direction away from the roller holder.

7. The conveying device according to claim 1, wherein the urging force adjuster is formed integrally with the guide member and moved in conjunction with the change in the state of the guide member.

8. The conveying device according to claim 1, wherein the urging force applier comprises: a resilient member configured to generate the urging force; and a cover which contacts an end portion of the resilient member, and wherein when the guide member is in the first state, the urging force adjuster positions the cover at a first position at which the resilient member generates a first urging force, and when the guide member is in the second state, the urging force adjuster positions the cover at a second position at which the resilient member generates a second urging force.

9. The conveying device according to claim 8, wherein the resilient member is a compression coil spring, and wherein a length of the compression coil spring is less when the cover is located at the first position than when the cover is located at the second position.

10. A conveying device, comprising:

a housing defining a conveyance path therein;

a guide rail in the housing;

a first roller disposed on the conveyance path;

a second roller opposed to the first roller;

a roller holder having first and second ends, the first end rotatably supporting a shaft of the second roller, the second end being pivotally attached to the guide rail;

a guide member pivotally attached to the housing having a side wall and a guide surface opposite the side wall, the guide member being movable between a first position in which the side wall forms a portion of a rear wall of the housing and the guide surface covers a part of the conveyance path, and a second position in which the guide surface is outside the housing and exposes the conveyance path;

a spring providing an urging force to the roller holder to bias the second roller toward the first roller;

a cover over a first end of the spring; and a tab extending from the guide member and movable with the guide member, wherein when the guide member is in the first position the tab contacts the cover and the guide rail and interacts with the spring to adjust the urging force to a first value, and when the guide member is in the second position the urging force is adjusted to a second value when the guide member is in the second state, the second value being less than the first value.

11. The conveying device according to claim 10, wherein the second roller is above the first roller.

12. The conveying device according to claim 10, wherein the spring is between the guide rail and the roller holder.

13. The conveying device according to claim 10, wherein the tab is between the spring and the guide rail when the guide member is in the first position.

14. The conveying device according to claim 10, wherein the guide rail defines an opening that receives the first end of the roller holder to pivotally attach the first end of the roller holder to the guide rail.

15. The conveying device according to claim 10, wherein the tab includes a projection portion extending upward from the tab, wherein the projection portion is received in an opening in the guide rail when the guide member is in the first position.

16. The conveying device according to claim 10, wherein the second end of the roller holder is disposed between the shaft of the second roller and the guide member.

* * * * *